US007196593B2

(12) United States Patent
Martin et al.

(10) Patent No.: US 7,196,593 B2
(45) Date of Patent: Mar. 27, 2007

(54) MICROWAVE CIRCULATOR WITH DEFORMABLE MEMBRANE

(75) Inventors: Siegbert Martin, Oppenweller (DE); Jurgen Ebinger, Aspach (DE); Konstantin Beis, Backnang (DE)

(73) Assignee: Marconi Communications GmbH, Backnang (DE)

( * ) Notice: Subject to any disclaimer, the term of this patent is extended or adjusted under 35 U.S.C. 154(b) by 62 days.

(21) Appl. No.: 10/491,399

(22) PCT Filed: Sep. 11, 2002

(86) PCT No.: PCT/IB02/03938

§ 371 (c)(1),
(2), (4) Date: Sep. 22, 2004

(87) PCT Pub. No.: WO03/032432

PCT Pub. Date: Apr. 17, 2003

(65) Prior Publication Data

US 2005/0110591 A1 May 26, 2005

(30) Foreign Application Priority Data

Oct. 10, 2001 (EP) ..... 01124118

(51) Int. Cl.
*H01P 1/38* (2006.01)

(52) U.S. Cl. ..... 333/1.1

(58) Field of Classification Search ..... 333/1.1, 333/24.2

See application file for complete search history.

(56) References Cited

U.S. PATENT DOCUMENTS 3,684,983 A * 8/1972 Cotter ..... 333/1.1
3,886,497 A 5/1975 Helszajn
3,928,824 A 12/1975 Takahashi et al.
4,672,333 A 6/1987 Bartels
4,791,389 A * 12/1988 Wolfert ..... 333/1.1

FOREIGN PATENT DOCUMENTS

| | | |
|---|---|---|
| DE | 44 22 251 A1 | 1/1996 |
| DE | 198 46 112 C1 | 5/2000 |
| EP | 0 005 801 A1 | 12/1979 |
| EP | 0 809 318 A1 | 11/1997 |
| GB | 1 245 788 | 9/1971 |
| GB | 2 059 171 A | 4/1981 |
| JP | 10-247802 | 9/1998 |

OTHER PUBLICATIONS

*Common Waveguide Circular Configurations*, Electronic Engineering, Sep. 1974, pp. 66, 67, 69.

* cited by examiner

*Primary Examiner*—Stephen E. Jones
(74) *Attorney, Agent, or Firm*—Kirschstein, et al.

(57) ABSTRACT

A circulator comprises a housing in two halves with a ferrite and associated magnet in a central portion of a first one of the halves, the second housing-half above the ferrite having a membrane which is deformable by operation of an adjuster upon the membrane, so as to adjust the size of an airgap between the membrane and the ferrite. The membrane is preferably the residual portion of the second housing-half following a milling operation to provide a recess, the recess accommodating the adjuster in the form of, e.g., a screw. To further enhance predictability of the performance characteristics of the circulator, the ferrite is seated in a hollow formed in the first housing-half and the securing of the ferrite to the first housing-half is by way of an adhesive applied between a lateral face of the ferrite and a corresponding lateral face of the hollow.

14 Claims, 3 Drawing Sheets

MICROWAVE CIRCULATOR WITH DEFORMABLE MEMBRANE

The invention relates to a circulator, and in particular a circulator for use in microwave applications.

Circulators are commonly employed to couple together a number of ports, in practice three, such that a signal entering the circulator at one of the ports can proceed in one direction only: e.g. from port 1 to port 2 (but not to port 3), port 2 to port 3 (but not to port 1), or port 3 to port 1 (but not to port 2). When one of the ports is connected to a matched load the device functions as an isolator; here signals between the other two ports can flow in one direction only.

Examples of conventional circulators and a typical circulator arrangement are shown in FIGS. 1(*a*), 1(*b*) and 2. FIG. 1(*a*) shows the construction of a known circulator, which comprise a housing 10 in two halves 11 and 12, each housing-half having a recess 13, 14 for accommodating a permanent magnet 15, 16 and having also a ferrite element 17, 18. The housing-halves are produced by a half-shell process, whereby the recesses 13, 14 and other discontinuities (e.g. transformer step sections 19) are formed by milling and, during assembly, the two housing-halves complete with ferrites and magnets are brought together and secured by suitable means so as to form a complete housing. A top view of such a structure along the mid-section is shown in FIG. 2, where the bottom half of the complete housing 10 with its associated ferrite 18 can be seen to couple to three microwave waveguide ports, 20, 21, 22 via a respective transformer sections 23, 24, 25.

An alternative realisation of the FIG. 1(*a*) device is shown in FIG. 1(*b*). Here, in contrast to the symmetrical arrangement of FIG. 1(*a*), only one ferrite 18 and permanent magnet 16 is employed and the transformer stage has steps only in that housing-half which accommodates these two items.

The performance of such a circulator depends strongly on a number of factors: chiefly the size and uniformity of the airgap 26 between the ferrite and the upper housing (FIG. 1(*b*)), or between the two ferrites (FIG. 1(*a*)), and the centrality of the location of the ferrite(s) in the housing. It is clear that performance is critically dependent on manufacturing and assembly tolerances, as illustrated in FIG. 3. As regards uncertainties in the size of the airgap (dimension A), the main-contributory factors are tolerances in the dimensions of the ferrite (dimension B) and of the housing assembly (dimension C) and tolerances in the thickness of the adhesive layer (dimension D) securing the ferrite to the housing. As regards uncertainties in the positioning of the ferrite in the housing, where conventionally a gauge or a template is used to locate the ferrite, there are tolerances in the accuracy of such gauge or template to take into account.

In accordance with a first aspect of the invention there is provided a circulator comprising: a housing in first and second halves and, in a central portion of the first housing-half and secured thereto, a ferrite element with associated magnet, a portion of the second housing-half adjacent the ferrite element having a deformable membrane, there being an airgap between the membrane and the ferrite element, the circulator comprising also an adjusting means for deforming the membrane, thereby to adjust the size of the airgap.

Preferably the adjusting element is accommodated in a recess formed in the second housing-half, the adjusting element being configured such as to bear down against the membrane, thereby to move it towards the ferrite element.

Advantageously the adjusting element is a screw having a thread which engages with a corresponding thread formed in the sides of the recess.

Preferably the recess is the end-result of a milling operation on the second housing-half and the membrane is that portion of the second housing-half which is left following the milling operation.

Advantageously the ferrite element is accommodated in a hollow formed in the first housing-half.

Preferably the hollow is dimensioned such that there is very little play between the ferrite element and the hollow. Advantageously the hollow and ferrite element form a friction fit with each other. Alternatively the hollow and ferrite element form an interference fit with each other.

Advantageously the ferrite element is secured to the hollow by an adhesive applied between a lateral face of the ferrite element and a corresponding lateral face of the hollow. Preferably the adhesive is disposed in grooves formed as extensions of the hollow in the first housing-half at intervals around the perimeter of the hollow. Preferably there are three grooves disposed approximately equidistantly around the perimeter of the hollow.

Advantageously the adhesive is applied such as to form a bead of adhesive at the grooves, the bead being readily detectable by visual inspection.

The use of an adhesive to secure the ferrite to a central portion of the first-housing half is considered inventive in its own right. Thus according to a second aspect of the invention there is provided a circulator comprising a housing in first and second halves and, in a central portion of the first housing-half and secured thereto, a ferrite element with associated magnet, wherein the ferrite element is secured to the first housing-half by an adhesive applied between a lateral face of the ferrite element and the first housing-half.

A circulator in accordance with the invention will now be described, by way of example only, with reference to the drawings, of which:

FIG. 1(*a*) and FIG. 1(*b*) are two embodiments of a known circulator, in side section, while FIG. 2 is a plan view through a plane II—II of the two embodiments;

Figure 4:
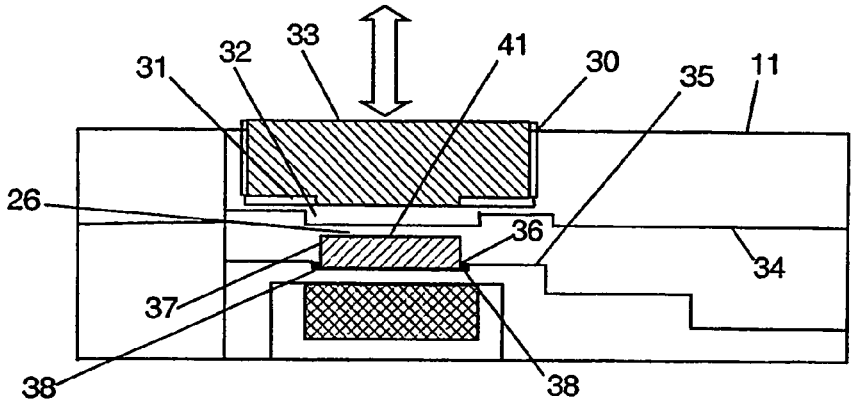
FIG. 4 is a partial sectional view of a circulator in accordance with the invention.
Figure 5:
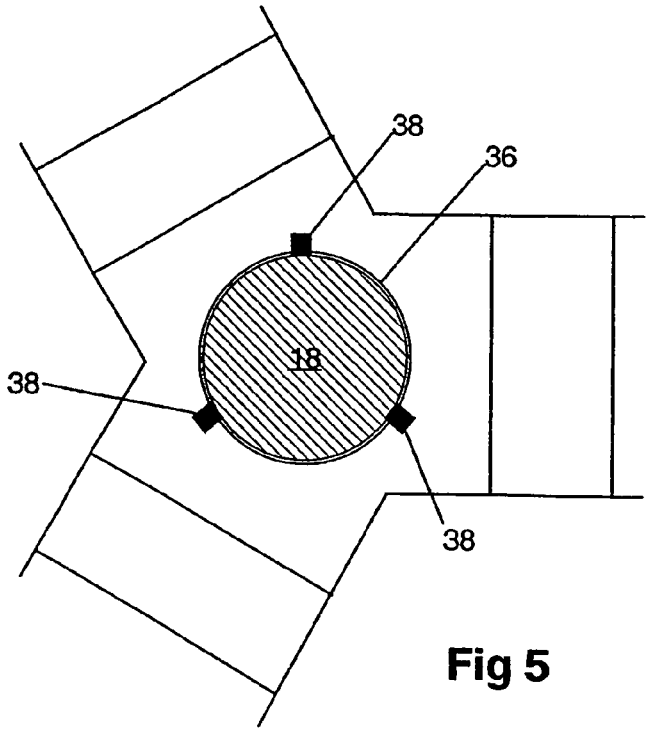
FIG. 5 is a partial plan sectional view of a preferred realisation of a circulator in accordance with the invention.

Turning now to FIG. 4, a circulator in accordance with the invention features three measures, each of which contributes to a reduction in uncertainty in performance due to manufacturing tolerances, and which together provide an enhanced certainty of performance.

In FIG. 4 the upper housing-half 11 has been milled away in a local area 30 to provide a recess 31 covering most of the depth of the housing-half. The portion of housing which is left following this milling operation serves as a membrane 32 which is thin enough to be elastically deformable in the direction shown by the double arrow. The airgap 26 is the space between the ferrite 18 and the underside of the membrane 32. In order to allow this airgap 26 to be adjusted, an adjusting element 33 is introduced into the recess which is made to bear with variable force against the upper face of the membrane 32. Since the membrane in its natural state will be undeformed and parallel to the housing face 34, the only deforming force in this arrangement will be one in a downwards direction, such that the membrane is forced nearer the ferrite 18, thereby reducing the airgap 26. In view of the unidirectional nature of this adjustment, the unadjusted airgap should be greater than that required in actual use.

In a preferred form of the invention, and as shown in FIG. 4, the adjusting element preferably takes the form of a screw having a thread which mates with a corresponding thread made in the recess 31. The screw is made of a magnetic material (preferably steel) and acts as a magnetic yoke.

Figure 3:
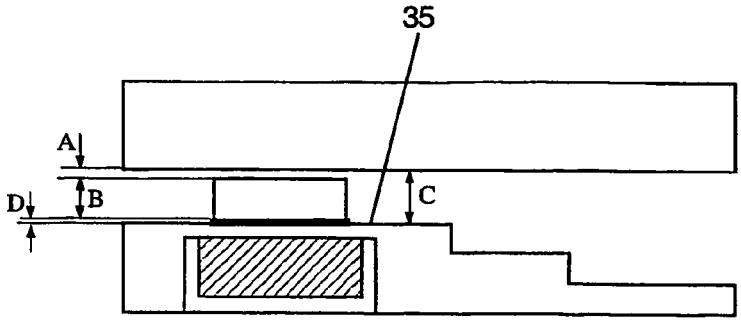
FIG. 3 is the circulator of FIG. 1(*b*) illustrating tolerances involved in the manufacture of the circulator.

The remaining two measures taken to enhance certainty of performance lies in the area of the securing of the ferrite element to the housing. Firstly, instead of securing the ferrite directly to the upper face 35 of the lower housing-half 12 (see FIG. 3), a hollow 36 is first made in the lower housing-half and the ferrite then introduced into that hollow. The lateral dimensions (diameter) of the hollow in relation to the lateral dimensions (diameter) of the ferrite should be such that as little movement as possible of the ferrite in the hollow is allowed. In practice, the relative dimensions of the ferrite and hollow 36 should ensure at least a friction fit, and preferably an interference fit. Secondly, in order to fix the ferrite in place, instead of applying adhesive to the underside of the ferrite as in the conventional scheme of FIG. 3, it is applied between the lateral face 37 of the ferrite and the walls of a number of further small recesses (radial grooves) 38, which constitute small local extensions of the main hollow 36. Thus the grooves are filled with adhesive, and this secures the ferrite in place.

The advantages of this scheme are:

(a) The ferrite cannot wander laterally due to the restraining action of the hollow 36.

(b) The mean height of the ferrite above the face 35 of the lower housing-half is predictable (ignoring any tolerances in the height of the ferrite itself that may exist), since the ferrite is not seated on any adhesive. In the conventional arrangement the bed of adhesive upon which the ferrite sits will be subject to certain squeezing forces; the magnitude of these forces and the initial depth and consistency of the adhesive layer all render the final height of the ferrite's upper face above the lower housing-half unpredictable.

(c) The size of the airgap 26 is uniform over the extent of the ferrite's upper face 41 (see FIG. 4). This is because there is no possibility of a build-up of adhesive anywhere under the ferrite.

Figure 6:
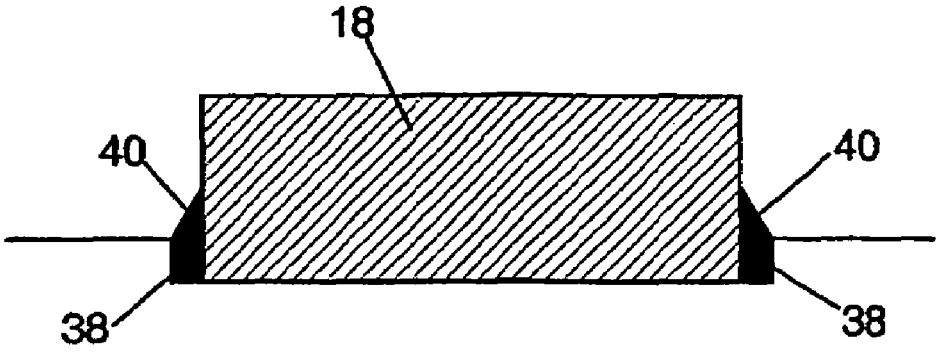
FIG. 6 illustrates a preferred mode of adhering the ferrite to the housing-half of a circulator in accordance with the invention.

In order to allow the quality of the adhesive bond to be inspected visually (see FIG. 6), it is expedient to apply sufficient adhesive such that it migrates above the grooves 38 and forms a local bead 40, which can be seen when looking into one or more of the ports in the direction shown.

Measurement of the airgap may take place by either optical or mechanical means, or alternatively the HF characteristics of the circulator may be monitored while the adjusting element is being operated. It is advantageous that, under the present invention, the only characteristics that would need to be monitored are the transmission or reflection parameters of the circulator.

Figure 1A:
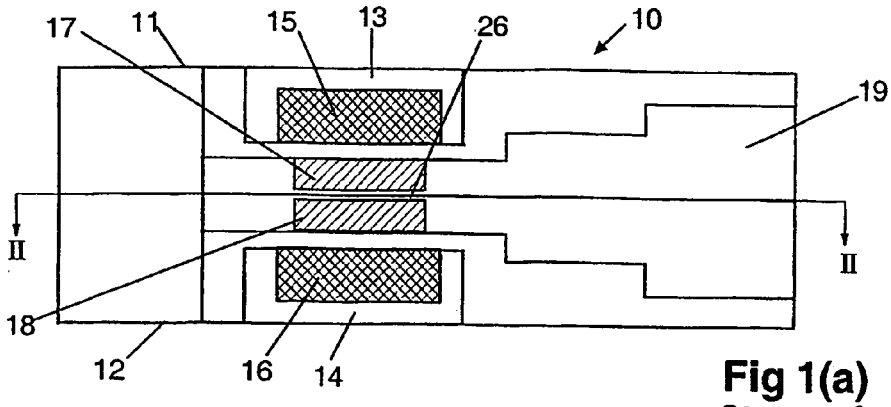
Fig 1(a) PRIOR ART
Figure 1B:
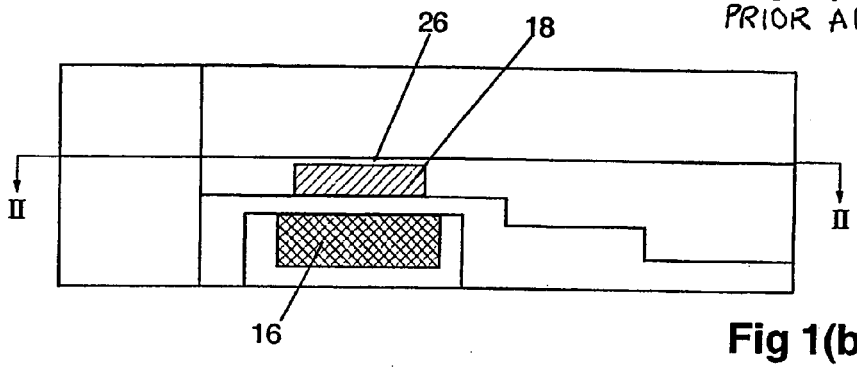
Fig 1(b) PRIOR ART
Figure 2:
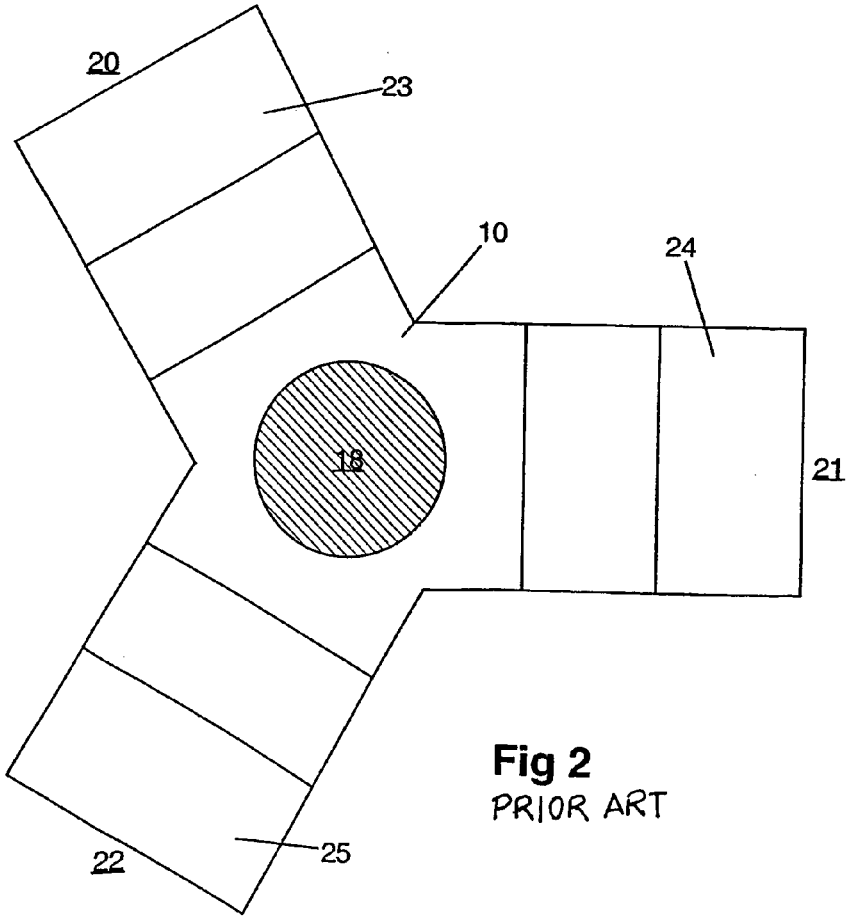
Fig 2 PRIOR ART
Figure 7:
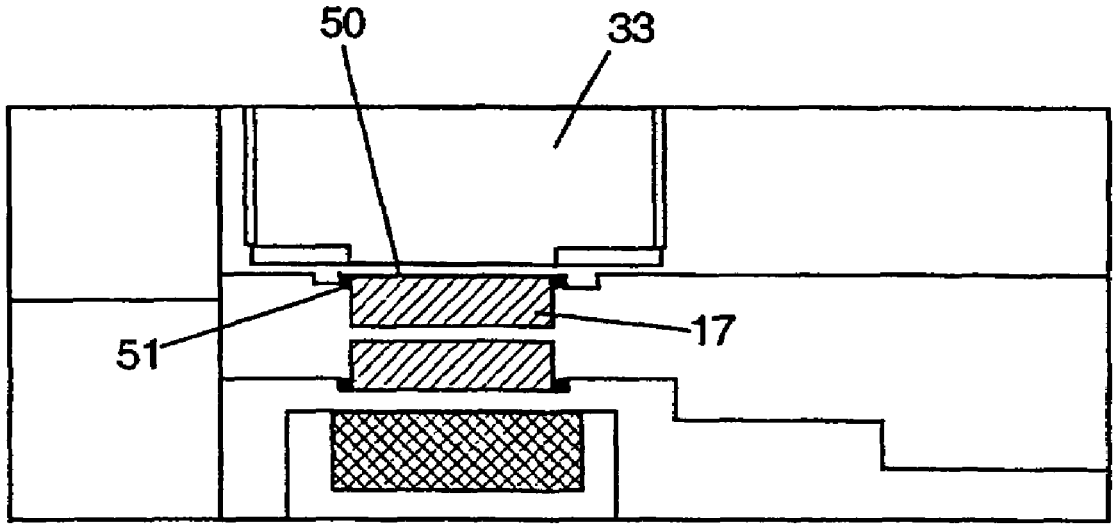
FIG. 7 shows a symmetrical version of the embodiment of the invention illustrated in FIG. 4.

Although the embodiment of the invention shown in FIG. 4 involves an asymmetrical circulator arrangement similar to that of FIG. 1(*b*), it is also possible to employ the invention in the symmetrical arrangement shown in FIG. 1(*a*). In this case (see FIG. 7) the second ferrite 17 is likewise secured in a second hollow 50 with associated grooves (radial recesses) 51 made in the second housing-half 11 using the adhesive method just described.

In a further variant of the present invention, the membrane is not formed from the housing itself, but is a component separate from the housing. In this arrangement, the upper housing-half is completely milled away to form a bore rather than merely a recess 31 and a thin elastically deformable membrane is fitted tightly into the inner opening of the bore. In this realisation it is, of course, necessary that this separate membrane be secured such that the downwards acting force of the adjusting element 33 does not loosen the membrane at all. Since this might be difficult to ensure in practice, the integral arrangement illustrated in FIG. 4 is preferred.

It is in principal conceivable that a membrane could be provided which was pre-tensioned such that it occupied a position nearer to the ferrite than that shown in FIG. 4. In this case adjustment of the airgap would be in an outward direction, i.e. in the sense of increasing the airgap by moving the membrane further away from the ferrite. This in turn would entail providing an adjusting element which was mechanically linked to the membrane so that, by turning e.g. the screw 33 in FIG. 4, the membrane was forced upwards. While this realisation is possible, it would be more difficult to put into practice than the scheme illustrated in FIG. 4, so that, again, the illustrated scheme is to be preferred.

The invention claimed is:

1. A circulator, comprising:

a) a housing having first and second halves, the first housing-half having an upper face;

b) a ferrite element in a central portion of the first housing-half and secured thereto, the ferrite element having an underside and at least one lateral face, the underside being positioned adjacent to the upper face of the first housing-half;

c) a magnet associated with the ferrite element; and d) the ferrite element being secured to the first housing-half by an adhesive applied between the at least one lateral face of the ferrite element and the first housing-half.

2. A circulator, comprising:

a) a housing having first and second halves;

b) a ferrite element in a central portion of the first housing-half and secured thereto;

c) a magnet associated with the ferrite element;

d) a portion of the second housing-half adjacent the ferrite element having a deformable membrane;

e) an airgap bounding the membrane and the ferrite element; and f) an adjusting means for deforming the membrane, thereby to adjust a size of the airgap.

3. The circulator as claimed in claim 2, wherein the adjusting means is accommodated in a recess formed in the second housing-half, the adjusting means being configured such as to bear down against the membrane, thereby to move the membrane towards the ferrite element.

4. The circulator as claimed in claim 3, wherein the adjusting means is a screw having a thread which engages with a corresponding thread formed in sides of the recess.

5. The circulator as claimed in claim 4, wherein the recess is an end-result of a milling operation on the second housing-half, and wherein the membrane is that portion of the second housing-half which is left following the milling operation.

6. The circulator as claimed in claim 4, wherein the screw is made of a magnetic material and acts as a magnetic yoke.

7. The circulator as claimed in claim 2, wherein the ferrite element is accommodated in a hollow formed in the first housing-half.

8. The circulator as claimed in claim 7, wherein the hollow is dimensioned such that there is minimal play between the ferrite element and the hollow.

9. The circulator as claimed in claim 8, wherein the hollow and ferrite element form a friction fit with each other.

10. The circulator as claimed in claim 8, wherein the hollow and ferrite element form an interference fit with each other.

11. The circulator as claimed in claim 7, wherein the ferrite element is secured to the hollow by an adhesive applied between a lateral face of the ferrite element and a corresponding lateral face of the hollow.

12. The circulator as claimed in claim 11, wherein the adhesive is disposed in grooves formed as extensions of the hollow in the first housing-half at intervals around a perimeter of the hollow.

13. The circulator as claimed in claim 12, wherein there are three grooves disposed approximately equidistantly around the perimeter of the hollow.

14. The circulator as claimed in claim 13, wherein the adhesive is applied such as to form a bead of adhesive at the grooves, the bead being readily detectable by visual inspection.

* * * * *